US006205314B1

(12) United States Patent
Tanaka et al.

(10) Patent No.: US 6,205,314 B1
(45) Date of Patent: Mar. 20, 2001

(54) DEVELOPING ROLLER WITH A COATING LAYER, DEVELOPER RESTRICTING MECHANISM AND DEVELOPING DEVICE INCORPORATING SAME

(75) Inventors: Nariaki Tanaka, Osakasayama; Takahiko Murata, Toyonaka; Masayuki Ishii, Suita; Seiji Kado, Minoo, all of (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/342,355

(22) Filed: Jun. 29, 1999

(30) Foreign Application Priority Data

Jul. 1, 1998 (JP) ..... 10-186073

(51) Int. Cl.[7] ..... G03G 15/08
(52) U.S. Cl. ..... 399/286; 492/53
(58) Field of Search ..... 399/286, 279, 399/265; 492/53, 56

(56) References Cited

U.S. PATENT DOCUMENTS 4,908,665 * 3/1990 Takeda et al. ..... 399/286
5,565,968 * 10/1996 Sawa et al. ..... 399/286
5,666,597 * 9/1997 Sasame et al. ..... 399/128

FOREIGN PATENT DOCUMENTS 10-254234 * 9/1998 (JP) .

* cited by examiner

*Primary Examiner*—Quana M. Grainger
(74) *Attorney, Agent, or Firm*—Jordan and Hamburg LLP

(57) ABSTRACT

A developing roller and a developing device are provided to enable a satisfactory developing operation. In order to accomplish this object, a roller main body of the developing roller is made of a roller base material containing acrylonitrile-butadiene rubber as a main component, and an adherence preventing coating layer is formed on the outer circumferential surface of the roller main body, thereby preventing the adherence of developer to the roller main body. Particularly, by setting the friction coefficient of the coating layer within a range of 0.5 to 0.95 inclusive and/or the glossiness thereof within a range of 4.5 to 8 inclusive, an occurrence of any of negative ghost, positive ghost and background fogging is prevented or suppressed to a level where no problem is presented in practical use.

16 Claims, 4 Drawing Sheets

DEVELOPING ROLLER WITH A COATING LAYER, DEVELOPER RESTRICTING MECHANISM AND DEVELOPING DEVICE INCORPORATING SAME

BACKGROUND OF THE INVENTION

1. Field of the Invention

The present invention relates to a developing device for visualizing an electrostatic latent image formed on a photosensitive drum by supplying developer, and to a developing roller used in the developing device.

2. Description of the Background Art

In an image forming apparatus such as a copier, a laser printer or a facsimile apparatus, an electrostatic latent image is formed on a photosensitive drum and is visualized, i.e. developed by supply developer to the photosensitive drum. A developing device is incorporated into the image forming apparatus in order to perform this developing operation. As an example of the developing device of this type, the one for visualizing an electrostatic latent image by developer comprised of, for example, single-component toner is known.

This developing device is provided with a developer container for storing the developer, a developing roller for supplying the developer in the developer container to the photosensitive drum and a developer restricting means which is brought into contact with the outer circumferential surface of the developing roller prior to the supply of the developer to the photosensitive drum to restrict a thickness of a developer layer held on the outer circumferential surface within a specified range. Among these elements, the developing roller has silicone rubber as a roller base material. A primer layer is formed on the outer circumferential surface of a roller main body made of this roller base material by spraying, and a top coating layer is formed on the outer circumferential surface of the primer layer. Thus, the developing roller has a so-called three-layer structure.

The developer restricting means has been conventionally made of a metal plate of, e.g. stainless steel or a glass plate, and the leading end thereof is brought into contact with the outer circumferential surface of the roller main body to make the thickness of the developer layer to be fed to the photosensitive drum thinner and uniform along the entire width of the developing roller.

However, the above developing roller is relatively expensive since it uses silicone rubber as the roller base material and the primer layer, which functions as an intermediate adhesive layer, needs to be always provided because the top coating layer cannot be directly formed on the roller main body. Accordingly, there has been a demand for less expensive developing rollers. In order to reduce the production costs of the developing roller, it may be considered to make a roller main body of acrylonitrile-butadiene rubber (hereinafter, "NBR") and use this roller main body as a developing roller without forming a top coating layer thereon as in a process cartridge disclosed, for example, in Japanese Patent Publication No. 2675286. However, developer (toner) adheres to the outer circumferential surface of the developing roller, with the result that a satisfactory developing operation cannot be performed.

Further, in order to perform a satisfactory developing operation, much attention needs to be given to the developer restricting means to be brought into contact with the outer circumferential surface of the developing roller. This is because the developer restricting means changes the charged state of the developer since it is held in contact with the outer circumferential surface of the developing roller while being biased in order to restrict the thickness of the developer layer as described above and is brought into contact with the developer when the thickness of the developer layer is restricted to thereby charge the developer in a specified state. However, it has been absolutely unknown how the developer restricting means should be used in relation to the developer in order to realize a satisfactory developing operation. Particularly, if the developer restricting means is not properly selected in relation to the developer, various inconveniences including fogging occur, thereby reducing the quality of an image.

In order to perform a satisfactory developing operation, not only the relation of the developer restricting means to the developer, but also the relation thereof to the developing roller needs to be studied. No sufficient studies have been made on this point thus far.

SUMMARY OF THE INVENTION

In view of the above problems, an object of the present invention is to provide a developing roller and a developing device which enable a satisfactory developing operation.

Specifically, the developing roller according to the present invention is designed to prevent an occurrence of negative ghost, positive ghost, fogging or like development failure or to suppress such development failures to a level where no substantial problem is presented in practical use even if they occur by forming an adherence preventing coating layer having a specified friction coefficient, glossiness or charging characteristics on the outer circumferential surface of a developing roller main body containing acrylonitrile-butadiene rubber as a roller base material.

Further, a developing device according to the invention is designed to solve the above problems by suitably setting the construction of the developing roller and/or charging characteristics of a developer restricting means held in contact with the outer circumferential surface of the developing roller.

These and other objects, features and advantages of the present invention will become more apparent upon a reading of the following detailed description and accompanying drawings.

DETAILED DESCRIPTION OF THE PREFERRED EMBODIMENTS OF THE INVENTION

A. Overall Construction and Operation of Printer

Figure 1:
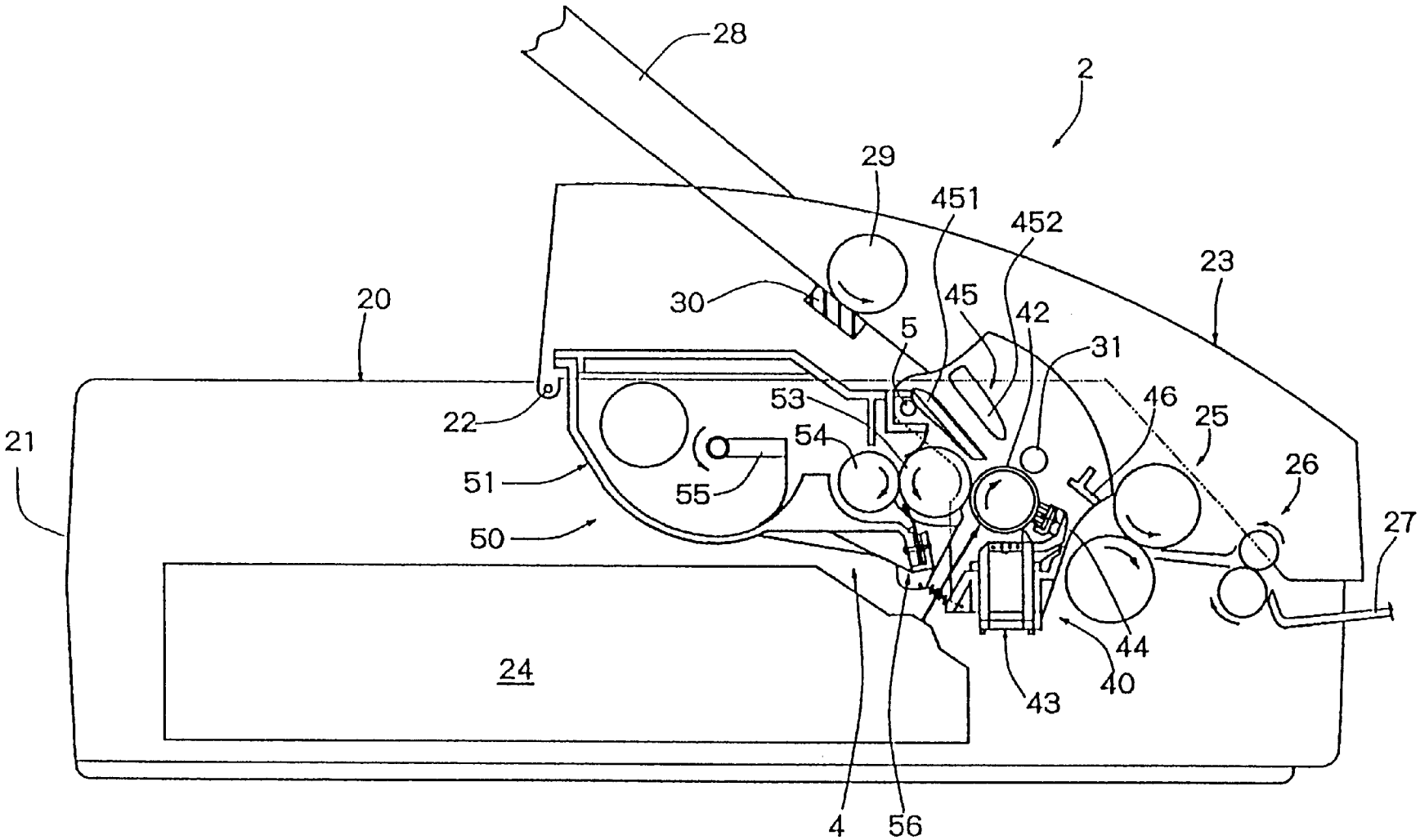
FIG. 1 is a side view in section of a printer incorporated with a developing unit as one embodiment of a developing device according to the invention.

FIG. 1 is a side view in section of a printer incorporated with a developing unit as one embodiment of a developing device according to the invention. This printer 2 is a small and low-speed laser printer used as a printing apparatus such as a word processor, and has a housing 20 made of synthetic resin. The housing 20 includes a box-shaped housing main body 21 having an open upper surface, and a cover 23 rotatably mounted about a shaft 22 disposed at the top of the housing main body 21. A process unit 4 is detachably mountable in a substantially middle portion of the housing 20 thus constructed.

The process unit 4 is constructed as described later. By mounting the process unit 4 in the housing 20 as shown in FIG. 1, the printer 2 is set in a state where printing can be performed. Specifically, by rotating the cover 23 of the housing 20 of the printer 2 about the shaft 22 counterclockwise in FIG. 1, the upper part of the housing main body 21 is opened. Then, the process unit 4 is mounted into the housing main body 21 from above. Thereafter, the upper part of the housing main body 21 is closed by rotating the cover 23 about the shaft 22 clockwise in FIG. 1. In the housing main body 21 is provided a positioning means (not shown) for placing a photosensitive drum unit 40 of the process unit 4 in a specified position.

Below the process unit 4 thus mounted in the housing 20 is provided a laser unit 24. The laser unit 24 projects a laser beam corresponding to a print data from, e.g. a word processor connected with the printer 2 to a photosensitive layer of a photosensitive drum 42 in an electrostatic latent image forming area (area 423 of FIG. 2 to be described later) of the process unit 4, thereby forming an electrostatic latent image. A transfer roller 31 of non-contact type is opposed to the photosensitive drum 42 in a transfer area (area 422 of FIG. 2 to be described later) in order to transfer the electrostatic latent image visualized or developed by a developing unit 50 to a transfer sheet. This transfer roller 31 is made of electrically conductive urethane foam and is rotatably supported on the cover 23. The transfer roller 31 is formed at its opposite ends with unillustrated collars made of insulating material such as synthetic resin and having an outer diameter larger than that of the transfer roller 31. The transfer roller 31 is provided such that the collars thereof are held in contact with the outer circumferential surface of the photosensitive drum 42. Accordingly, the transfer roller 31 is driven as the photosensitive drum 42 rotates.

In the printer 2, a sheet transporting mechanism is constructed as follows in order to feed transfer sheets to the process unit 4 and discharge them after the image transfer. Specifically, a feed tray 28 on which transfer sheets are placed is provided in the cover 23, and a feed roller 29 and a friction pad 30 used to separate the transfer sheets are provided opposite to each other downstream from the feed tray 28. The feed roller 29 is driven in a direction of arrow by an unillustrated driving means. As the feed roller 29 is rotated, the transfer sheets are fed toward the process unit 4 one by one while being separated from a stack of sheets placed on the feed tray 28. The cover 23 is also provided with upper and lower guide plates 452, 451 which construct a pre-transfer guide plate pair 45. The transfer sheet fed toward the process unit 4 is guided to the transfer roller 31 by the upper and lower guide plates 452, 451. Further, a post-transfer guide plate 46 is mounted on the housing main body 21 for guiding the transfer sheet onto which an image is transferred by the transfer roller 31 from the process unit 4 toward a fixing roller pair 25. The fixing roller pair 25 is provided downstream from the post-transfer guide plate 46, and the transfer sheet having passed between the fixing roller pair 25 is discharged onto a discharge tray 27 via a discharge roller pair 26.

Next, the operation of the printer 2 thus constructed is briefly described.

The respective members start operating in accordance with a print command from an unillustrated word processor or the like, and the photosensitive layer of the photosensitive drum 42 is substantially uniformly charged at a specific polarity by a corona discharge device provided in the process unit 4. Subsequently, the laser unit 24 projects a laser beam corresponding to a print data from the word processor or the like onto the charged outer surface of the photosensitive layer of the photosensitive drum 42, thereby forming an electrostatic latent image. The electrostatic latent image thus formed on the photosensitive layer of the photosensitive drum 42 is developed into a toner image by the development action of the developing unit 50. The development action of the developing unit 50 is described in detail later.

On the other hand, the transfer sheets placed on the feed tray 28 are fed while being separated one by one by the action of the feed roller 29 and the friction pad 30. The fed transfer sheet is guided by the pre-transfer guide plate pair 45 to be conveyed between the photosensitive drum 42 and the transfer roller 31, and the toner image formed on the outer surface of the photosensitive drum 42 is transferred to the transfer sheet. The transfer sheet bearing the transferred toner image is guided by the post-transfer guide plate 46 to be conveyed to the fixing roller pair 25. The transfer sheet having the toner image heated and fixed thereto by the fixing roller pair 25 is discharged onto the discharge tray 27 by the discharge roller pair 26. On the other hand, the outer circumferential surface of the photosensitive drum 42 having passed the transfer area 425 has paper particles or like foreign matter adhered thereto removed by a foreign matter collecting brush 44. At this time, the residual toner adhered to the outer circumferential surface of the photosensitive drum 42 is removed together with the foreign matter such as paper particles.

B. Construction of the Process Unit

Figure 2:
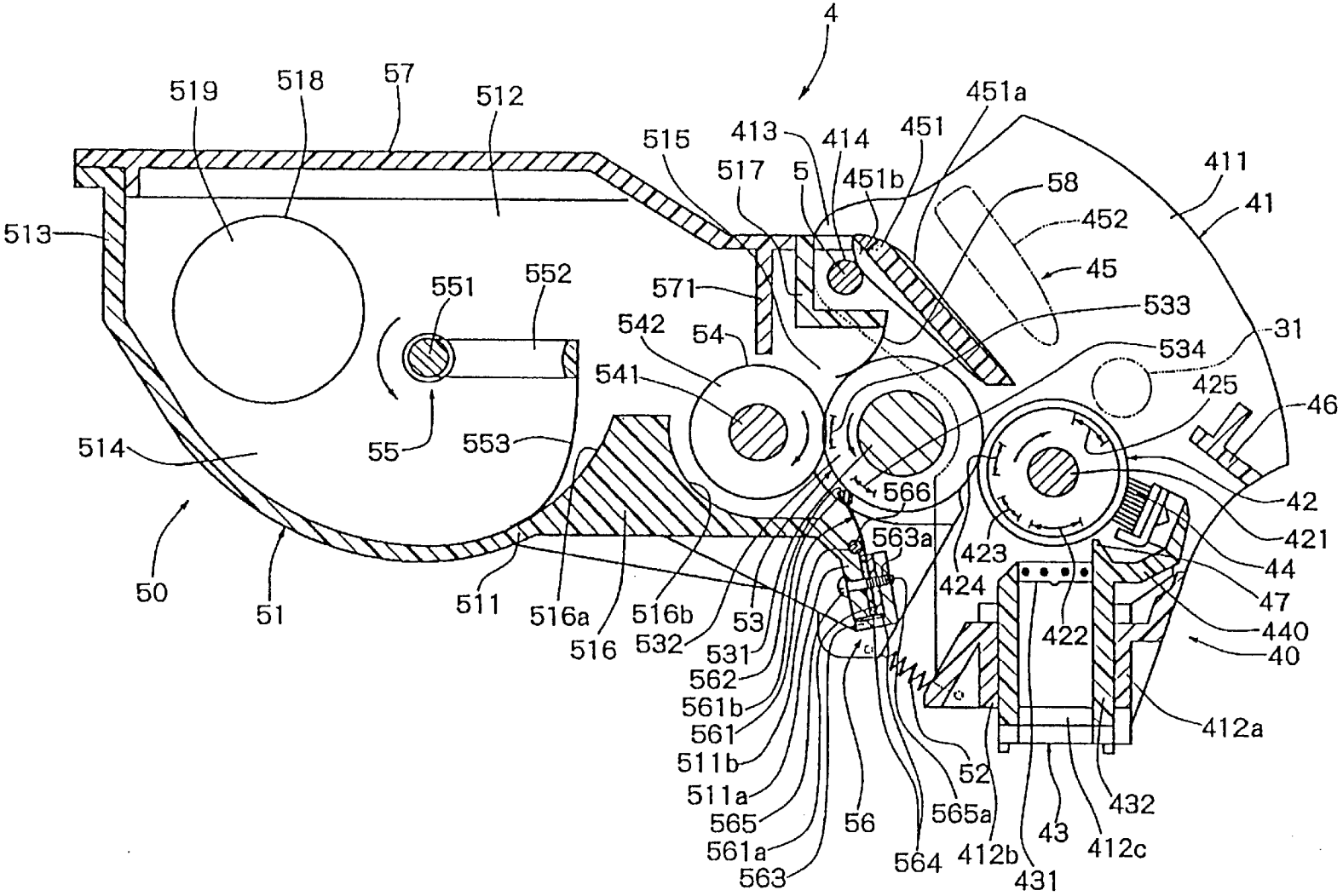
FIG. 2 is a section of a process unit used for the printer of FIG. 1.

FIG. 2 is a diagram showing the process unit 4 used in the printer of FIG. 1. This process unit 4 is, as shown in FIG. 2, provided with the photosensitive drum unit 40, and the developing unit 50 pivotally supported on the photosensitive drum unit 40 via a support shaft 5. Hereafter, the photosensitive drum unit 40 and the developing unit 50 are separately described.

B-1. Photosensitive Drum Unit 40

The photosensitive drum unit 40 includes a photosensitive drum supporting means 41, which is provided with a pair of side wall members 411 (only the side wall member at the back side is shown in FIG. 2) which are spaced apart along forward and backward directions, and coupling members 412*a*, 412*b* for coupling the bottom parts of the respective side wall members 411. The coupling members 412*a*, 412*b* are spaced apart by a specified distance such that the inner surfaces thereof facing each other are parallel to each other. A space 412*c* defined by such an arrangement functions as a charging means mounting space for arranging a charging means to be described later and is located in a position opposite to a charging area to be described later.

The photosensitive drum supporting means 41 thus constructed is integrally made of synthetic resin. At the upper ends of sides of the pair of side wall members 411 toward the developing unit 50 are provided support portions 413 each formed with a mount hole 414. By inserting the support shaft 5 made of a metal bar and provided in a housing of the developing unit 50 to be described later into the mount holes 414 of the support portions 413, the photosensitive drum 40 and the developing unit 50 are pivotally supported with respect to each other.

The photosensitive drum unit 40 includes the photosensitive drum 42 having a photosensitive layer formed on its outer circumferential surface. The photosensitive drum 42 is provided with a rotatable shaft 421, which is rotatably supported on the pair of side wall members 411, and is so rotated in the direction of arrow by an unillustrated driving means as to pass the charging area 422, the electrostatic latent image forming area 423, the developing area 424 and the transfer area 425 in this order.

In the charging means mount space 412*c* located in the charging area 422, a charging means 43 is so mounted as to face the outer circumferential surface of the lower part of the photosensitive drum 42. The charging means 43 is comprised of a corona discharge device 431 as a charger provided in parallel with the longitudinal direction of the photosensitive drum 42 and a charger holder 432 made of synthetic resin for holding the mounted corona discharge device 432. The charging means 43 is located in a specified position by fitting the charger holder 432 into the charging means mount space 412*c*.

Between the charging area 422 and the transfer area 425 is provided the foreign matter collecting brush 44, which is held in contact with the outer circumferential surface of the photosensitive drum 42, along the longitudinal direction of the photosensitive drum 42. This brush 44 is made of acrylic fiber or the like and has substantially the same length as the photosensitive drum 42. Such a brush 44 is mounted on a brush supporting member 440 which is integrally formed with the charger holder 432 and is provided along the longitudinal direction of the photosensitive drum 42.

The upper end of the charger holder 432 projects so as to be proximate to the outer circumferential surface of the photosensitive drum 42 between the corona discharge device 431 provided in the charging area 422 and the foreign matter collecting brush 44, thereby constructing a toner entrance preventing wall 47. This preventing wall 47 has a function of preventing the residual toner adhered to the outer circumferential surface of the photosensitive drum 42 and removed together with the foreign matter such as paper particles by the brush 44 from entering the corona discharge device 431 in the case that the residual toner falls without being securely caught by the brush 44. As a result, the toner having its movement blocked by the preventing wall 47 is accumulated on a horizontal portion of the brush 44 near the preventing wall 47.

Between the pair of side wall members 411 of the photosensitive drum supporting means 41 is provided the lower guide plate 451 of the pre-transfer guide plate pair 45 for guiding the transfer sheet being fed obliquely downward to the left in FIG. 2 toward the transfer area 425 on the outer circumferential surface of the photosensitive drum 42. This lower guide plate 451 is integrally formed with the pair of side wall members 411. A plurality of guide ribs 451 a are integrally formed at specified intervals along longitudinal direction (direction normal to the plane of FIG. 2) on the upper surface of the lower guide plate 451. The lower guide plate 451 is also integrally formed on its lower surface with a plurality of reinforcement ribs 451*b* along longitudinal direction (direction normal to the plane of FIG. 2). These reinforcement ribs 451*b* can be brought into contact with the support shaft 5. Accordingly, even if a pushing force acts on the upper surface of the lower guide plate 451, thereby trying to deflect it, the reinforcement ribs 451*a* are brought into contact with the support shaft 5 to prevent the lower guide plate 451 from being deflected.

The lower guide plate 451 also functions as a coupling member for coupling the upper portions of the side wall members 411 of the photosensitive drum supporting means 41, thereby improving the hardness and strength of the photosensitive drum supporting means 41. Further, since the lower guide plate 451 is integrally formed with the side wall members 411 in the illustrated embodiment, it can be held highly precisely positioned with respect to the photosensitive drum 42 rotatably supported on the side wall members 411. The lower guide plate 451 in the illustrated embodiment also functions as a contact preventing member for preventing any contact with the photosensitive layer of the photosensitive drum 42 when the process unit 4 is attached and detached and as another contact preventing member for preventing any contact with a developing roller of the developing unit 50 to be described later, and also has an additional function of preventing the toner flying from the outer surface of the developing roller from adhering to transfer sheets and a transport path for the transfer sheets.

Between the side wall members 411 is also provided the post-transfer guide plate 46 for guiding the transfer sheet having a toner image transferred thereto in the transfer area 425 to a fixing means to be described later. This post-transfer guide plate 46 is integrally formed with the side wall members 411. Accordingly, the guide plate 46 functions as a coupling member for coupling the side wall members 411 of the photosensitive drum supporting means 41, thereby improving the hardness and strength of the photosensitive drum supporting means 41. It should be noted that the guide plate 46 in the illustrated embodiment can also function as a contact preventing member for preventing any contact with the photosensitive layer of the photosensitive drum 42 when the process unit 4 is attached and detached.

B-2. Developing Unit 50

Next, the developing unit 50 as the embodiment of the present invention is described. This developing unit 50 has a housing 51 for storing developer made of single-component toner. The housing 51 is comprised of a bottom wall 511, front and rear walls 512 (only the rear wall is shown in FIG. 2) standing upward from the front and rear ends (ends with respect to a direction normal to the plane of FIG. 2) of the bottom wall 511, and a left wall 513. These walls are integrally made of synthetic resin to define an agitating chamber 514 and a developing chamber 515.

The bottom wall 511 of the housing 51 is integrally formed with a partition wall 516 which extends along forward and backward directions (directions normal to the plane of FIG. 2) between the agitating chamber 514 and the developing chamber 515. The left and right surfaces of the partition wall 516 are formed with arcuate guide surfaces 516*a* and 516*b*, respectively.

Between the front and rear walls of the housing 51 is provided a coupling member 517, which is located in an upper part of the developing chamber 515 and is integral to the front and rear walls 512. The rear wall 512 is formed with a toner supply hole 518, in which a cap 519 is fitted.

At the upper end of the developing chamber 515 of the housing 51 thus constructed, the support shaft 5 is provided while penetrating through the front and rear walls 512. By fitting the mount holes 414 formed in the support portions 413 of the side wall members 411 of the photosensitive drum supporting means 41 to the opposite ends of the support shaft 5, the photosensitive drum unit 40 and the developing unit 50 are pivotally supported with respect to each other as described above. Between the bottom part of the photosensitive drum supporting means 41 and the bottom part of the housing 51 are provided coil springs 52 as spring means at the front and rear ends. The photosensitive drum supporting means 41 and the housing 51 are so biased as to be pulled toward each other by the coil springs 52 with the support shaft 5 as a fulcrum. The upper and right sides of the housing 51, i.e. the sides thereof toward the photosensitive drum unit 40 are open.

In the housing 51 are provided a developing roller 53, a supply roller 54, an agitating means 55 and a developer restricting means 56.

Figure 3:
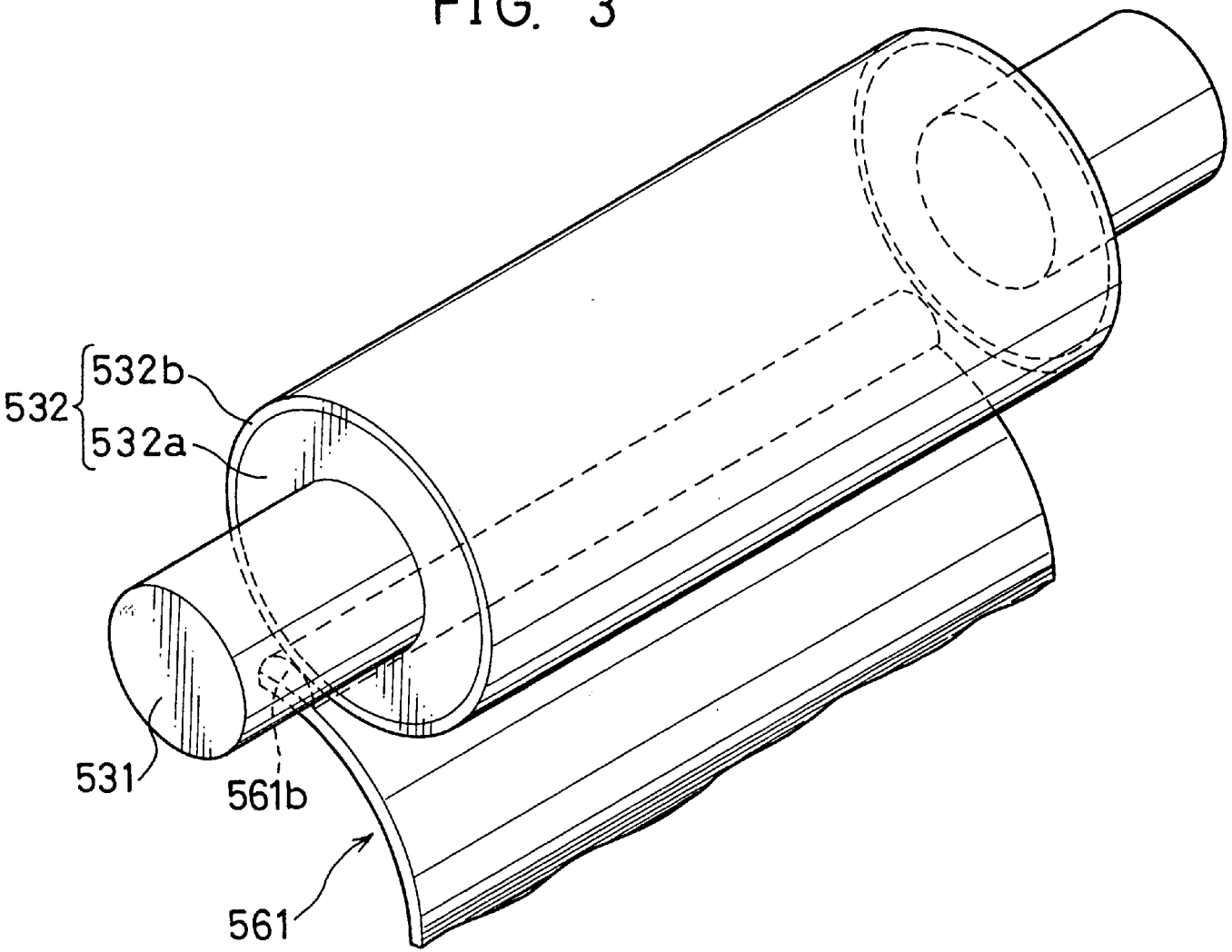
FIG. 3 is a perspective view showing a developing roller and a developer restricting means.

FIG. 3 is a perspective view showing the developing roller 53 and the developer restricting means 56. As shown in FIGS. 1 and 2, the developing roller 53 is comprised of a rotatable shaft 531 and a roller 532 secured to the outer circumferential surface of the rotatable shaft 531. The rotatable shaft 531 is made of a suitable metal material such as stainless steel and is rotatably mounted on the front and rear walls 512 in the developing chamber 515 of the housing 51. On the other hand, the roller 532 is comprised of a roller main body 532 made by using NBR (acrylonitrile-butadiene rubber) as roller base material to have a semiconductor property, and a coating layer 532*b* formed on the outer circumferential surface of the roller main body 532*a* to function as an adherence preventing coating layer for preventing the adherence of developer to the roller 532. In order to perform a satisfactory developing operation, it is desirable to set a friction coefficient of the coating layer 532*b* at 0.5 to 0.75 and a glossiness at 4.5 to 8. This is because image quality is reduced due to an occurrence of so-called "negative ghost" when the friction coefficient and glossiness are high as shown in Examples described later and due to an occurence of so-called "positive ghost" and fogging, on the other hand, when they are low. In order to perform a satisfactory developing operation by preventing the occurrence of the above problems, it is desirable to set the friction coefficient and glossiness of the coating layer 532*b* within the above ranges.

The developing operation can be made more satisfactory by controlling the charging characteristics of the coating layer 532*b*. Specifically, if the coating layer 532*b* has such charging characteristics that the charging tendency thereof is ranked below the toner if the developer is positively chargeable toner, whereas it is ranked above the toner if the developer is negatively chargeable toner, and is distanced from that of the developer in electrification rank, then the charged state of the developer is stabilized and the entire developer on the coating layer 532*b* can be charged at the same polarity, thereby increasing an charged amount and suppressing a charging variation. As a result, the developing operation can be made satisfactory.

More specifically, in the case that the developer is positively chargeable toner, the coating layer 532 itself can be easily negatively charged and has a tendency to be negatively charged by the friction with the toner if being made of fluorocarbon resin, silicone resin or like resin having an electron attracting property. As a result, the toner on the coating layer 532*b* is more stably and securely positively charged. Conversely, in the case that the developer is negatively chargeable toner, the coating layer 532 itself can be easily positively charged and has a tendency to be positively charged by the friction with the toner if being made of nylon resin, urethane resin or like resin having an electron donating property. As a result, the toner on the coating layer 532*b* is more stably and securely negatively charged.

In this embodiment, positively chargeable toner is used as the developer and the coating layer 532*b* is made of fluorocarbon resin materials having an electron attracting property and the following properties. The effects obtained when the coating layer 532*b* is made of the respective materials are described in detail with respect to "Examples" later.

TABLE 1

| | Friction Coefficient | Hardness *1 | Resistance Value (Ω) *2 |
|---|---|---|---|
| Coating layer Material 1 | 0.9 | 75° | $1.32 \times 10^7$ |
| Coating layer Material 2 | 0.75 | 75° | $3.3 \times 10^6$ |
| Coating layer Material 3 | 0.7 | 75° | $4.5 \times 10^6$ |
| Coating layer Material 4 | 0.6 | 75° | $8.7 \times 10^6$ |
| Coating layer Material 5 | 0.55 | 75° | $6.2 \times 10^5$ |
| Coating layer Material 6 | 0.5 | 75° | $1.8 \times 10^6$ |

*1: Hardness (in Asker C)
*2: Resistance when 100 Volts applied

The roller 532 of the developing roller 53 thus constructed is exposed to the outside through a right side opening formed in the housing 51 and is so positioned as to face the photosensitive drum 42. The outer circumferential surface of the roller 532 is pressed against the outer circumferential surface of the photosensitive drum 42 in the developing area 424, and is slightly elastically compressed in a nip portion with the photosensitive drum 42.

The rotatable shaft 531 of the developing roller 53 is rotated by an unillustrated driving means in a direction of arrow, i.e. from the lower side to the upper side in the developing area 424 which is a contact area of the roller 532 and the photosensitive drum 42. The roller 532 is also rotated in the direction of arrow by the rotation of the rotatable shaft 531, and the outer circumferential surface thereof successively passes a developer holding area 533, a developer restricting area 534 and the developing area 424 in this order.

The supply roller 54 is provided in parallel with the developing roller 53 in the developing chamber 515 of the housing 51, and is comprised of a rotatable shaft 541 rotatably mounted on the front and rear walls 512 of the housing 51 and a roller 542 secured to the outer circumferential surface of the rotatable shaft 541. The rotatable shaft 541 can be made of a suitable metal material such as stainless steel similar to that of the developing roller 53. The roller 542 is made of silicone foam, urethane foam or like foamed material. The roller 542 is pressed against the roller 532 of the developing roller 53 in the developer holding area 533 which is a nip portion with the developing roller 53. The hardness of the foamed material forming the roller 542 of the supply roller 54 is considerably smaller than that of the roller 532 of the developing roller 53 (e.g. about 353 in (Asker C)), and it is desirable to elastically compress the roller 542 by about 0.1 to 0.6 mm in the nip area by being pressed against the roller 532 of the developing roller 53. The roller 542 also has an electrical conductivity. The rotatable shaft 541 of the supply roller 54 is rotated by an unillustrated driving means in a direction of arrow, i.e. from the upper side to the lower side in the developer holding area 533 which is a nip portion of the roller 542 and the roller 532 of the developing roller 53. The roller 542 is also rotated in the direction of arrow by the rotation of the rotatable shaft 541.

A relationship of a peripheral velocity V1 of the photosensitive drum 42, that of the developing roller 53 and that of the supply roller 54 is defined by $V1<V2<V3$. In the illustrated embodiment, the relationship between the peripheral velocity V1 of the photosensitive drum 42 and that of the developing roller 53 is defined by $1.2V1 \leqq V2 \leqq 2.5V1$, and the relationship between the peripheral velocity V2 of the developing roller 53 and that of the supply roller 54 is defined by $1.0V2 \leqq V3 \leqq 2.0V2$. The reasons for setting the above relationships are as follows.

If the peripheral velocity V2 of the developing roller 53 is 1.2V1 or below 1.2V1, the supply of the developer to the photosensitive drum 42 is insufficient, causing a reduction in image density, and an action of the developing roller 53 to scrape off the residual developer still adhered to the photosensitive drum 42 after the image transfer is reduced, with the result that such developer cannot be removed from the photosensitive drum 42. Such developer, which has not been transferred to the transfer sheet, causes so-called offset fogging. On the other hand, if the peripheral velocity V2 of the developing roller 53 is 2.5V1 or above 2.5V1, a drive torque of the developing roller 53 is increased and the developer may be scattered due to a centrifugal force.

If the peripheral velocity V3 of the supply roller 54 is 1.0V2 or below 1.0V2, the supply of the developer to the developing roller 53 is insufficient, causing a reduction in image density, and an action of the supply roller 54 to scrape off the developer on the outer circumferential surface of the developing roller 53 is weak. Accordingly, if the residual developer still adhered to the photosensitive drum 42 after the image transfer is adhered to the developing roller 53, it is difficult to remove the adhered developer, which in turn causes a so-called ghost phenomenon which occurs during a next development. On the other hand, if the peripheral velocity V3 of the supply roller 54 is 2.0V2 or above 2.0V2, the drive torque of the supply roller 54 is increased, and the developer comes to have a stronger tendency to reside above the nip portion of the supply roller 54 and the developing roller 53, causing a supply shortage of the developer to the developing roller 53.

In the agitating chamber 514 of the housing 51 is provided the agitating means 55. The agitating means 55 includes a rotatable shaft 551 which is provided in parallel with the supply roller 54 and rotatably mounted on the front and rear walls 512 of the housing 51, an agitating member 552 secured to this rotatable shaft 551, and an elastic agitating sheet member 553 mounted on the agitating member 552. The agitating member 552 is made of synthetic resin, and is formed with a plurality of openings along its longitudinal direction (direction normal to the plane of FIG. 2). The agitating sheet member 553 is made of, e.g. polyethylene terephthalate (PETP) having flexibility, and is secured to the leading edge of the agitating member 552 by adhesive or the like. The agitating means 55 thus constructed is continuously rotated in a direction of arrow in FIG. 2 by an unillustrated driving device.

Next, the developer restricting means 56 is described. The developer restricting means 56 includes a restricting blade 561 formed by arranging a flexible thin steel plate, e.g. a thin stainless steel plate, having substantially the same length as the roller 532 of the developing roller 53 substantially in parallel with the roller 532. On the front surface (surface facing the developing roller 53) of a leading end (restricting portion) 561*b* of the restricting blade 561 is mounted a restricting member 562, which is made of a material having specific charging characteristics corresponding to those of the developer similar to the coating layer 532*b* of the developing roller 53 (electron attracting material in the case of positively chargeable toner, whereas electron donating material in the case of negatively chargeable toner). For example, if positively chargeable toner is used as the developer, the restricting member 562 is made of a material whose charging tendency is ranked below the toner and is distanced from that of the developer in the electrification rank. Materials having such characteristics (electron attracting materials) specifically include silicone rubber, CR rubber (chloroprene rubber), natural rubber, fluorocarbon resin, etc. In this embodiment, positively chargeable toner is used as the developer and silicone rubber is used as the material of the restricting member 562 since various experimental results showed that silicone rubber was best in precisely controlling the thickness of the developer layer. This restricting member 562 has a semicircular cross section having a radius of about 1 mm in the illustrated embodiment, and has substantially the same length as the longitudinal dimension of the restricting blade 561. A planar portion of the restricting member 562 is secured to the front surface of the restricting portion 561*b* by adhesive.

On the other hand, a rear end (mount portion) 561*a* of the restricting blade 561 is mounted on a blade mount portion 511*a* provided at the open end of the bottom wall 511 of the housing 51 toward the photosensitive drum unit 40 by being tightly held by a pressing plate 563. Specifically, elastic members 564 made of urethane rubber sheet material and having a thickness of about 0.2 to 0.3 mm are provided between the mount portion 561*a* of the restricting blade 561 and the pressing plate 563 and between the mount portion 561*a* and the blade mount portion 511*a* of the housing 51 in the illustrated embodiment. The blade mount portion 511*a* of the housing 51, the mount portion 561*a* of the restricting blade 561, the elastic members 564 and the pressing plate 563 are each formed with a plurality of screw holes in corresponding positions at specified intervals. A plurality of screws 565 are inserted through the plurality of screw holes formed in the respective members from the side of the blade mount portion 511*a,* and externally threaded portions formed at the leading ends of the screws 565 are spirally engaged with internally threaded portions 563*a* formed in the screw holes of the pressing plate 563. In this way, the mount portion 561*a* of the restricting blade 561 is fastened to the blade mount portion 511*a* by being tightly held by the pressing plate 532 via the elastic members 564.

Above the blade mount portion 511*a* of the housing 51 is formed a fulcrum member mount portion 511*b* which extends along forward and backward directions (directions normal to the plane of FIG. 2). This mount portion 511*b* is formed by a groove having an arcuate cross section in the illustrated embodiment. A fulcrum member 566 is provided on the mount portion 511*b*. The mount portion 511*b* is made of a round metal bar having a diameter of about 2 mm in the illustrated embodiment, and has substantially the same length as the longitudinal dimension of the restricting blade 561. The fulcrum member 566 is placed on the mount portion 511*b,* and is held in contact with the underside (surface at a side opposite from the side where the restricting member 562 is mounted) of the restricting blade 561 between the mount portion 561*a* and the restricting portion 561*b*. The fulcrum member 566 is desirably provided in a position in contact with the restricting blade 561 or as distant from the restricting member 562 as possible in order to make the restricting member 562 smaller. In the developer restricting means 56 thus constructed, the restricting blade 561 is held with the fulcrum member 566 as a fulcrum and the restricting member 562 mounted on the front surface of the restricting portion 561*b* is held in pressing contact with the outer circumferential surface of the roller 532 of the developing roller 53 in the developer restricting area 534. Since the developer restricting means 56 is constructed as above and the fulcrum member 566, which serves as a fulcrum of deflection of the restricting blade 561, is made of a round bar member, a relatively precise fulcrum portion can be produced at low price. Although the round bar member is used as the fulcrum member 566 in the illustrated embodiment, a rectangular bar member may be used.

A lid 57 for covering the open upper portion is mounted on the housing 51. The lid 57 is made of synthetic resin, and is secured to the upper surfaces of the front, rear walls 512, the left wall 513 and the coupling member 517 of the housing 51 by adhesive. On the inner surface of the lid 57 is integrally formed a restricting portion 571 which extends along forward and backward directions (directions normal to the plane of FIG. 2) in a position facing the supply roller 54 and projects toward the developing chamber 515. The bottom end of the restricting portion 571 and the outer circumferential surface of the roller 542 of the supply roller 54 are spaced apart by a specified distance.

In the illustrated embodiment, a sheet-like seal member 58 is mounted on the coupling member 517 of the housing 51. The seal member 58 is made of a flexible sheet member such as polyethylene terephthalate (PETP), and has substantially the same length as the longitudinal dimension of the roller 532 of the developing roller 53. The seal member 58 has one end thereof secured to the coupling member 517 by securing means such as adhesive and the other end thereof curved to be elastically brought into contact with the outer circumferential surface of the roller 532 of the developing roller 53. The seal member 58 thus constructed prevents the scattering of the developer through the opening of the housing 51 toward the photosensitive drum unit 40 in cooperation with the blade 561 of the developer restricting means 56.

C. Operation of the Developing Unit 50

Next, the developing operation of the developing unit 50 is described

Upon the start of the operation of the developing unit 50, the developing roller 53, the supply roller 54 and the agitating means 55 are rotated in the respective directions of arrow by the unillustrated driving devices. By the rotation of the agitating member 552 and the sheet member 553 of the agitating means 55 in the corresponding direction of arrow, the developer contained in the agitating chamber 514 is supplied into the developing chamber 514 from above the supply roller 54 after passing over the partition wall 516 while being agitated. At this time, the restricting portion 571 formed on the inner surface of the lid 57 restricts an amount of the developer so as to prevent an oversupply of the developer into the developing chamber 514.

The developer supplied by the agitating means 55 is conveyed to the developer holding area 533, which is the nip portion with the roller 532 of the developing roller 53, while resting on the roller 542 of the supply roller 54. Since the supply roller 54 and the developing roller 53 are rotated in the same direction from the upper side to the lower side in the developer holding area 533 as the nip portion, the developer can be sufficiently supplied from the supply roller 54 to the developing roller 53, thereby preventing a supply shortage of the developer. Further, since the supply roller 54 and the developing roller 53 are rotated in the same direction in the developer holding area 533 which is the nip portion between these rollers, they can be securely driven without necessitating a large driving force.

The developer thus conveyed to the developer holding area 533 is further conveyed to the developer restricting area 534 while resting on the outer circumferential surface of the roller 532 of the developing roller 53. At this time, since the supply roller 54 and the developing roller 53 are rotated in the same direction from the upper side to the lower side in the developer holding area 533, the developer is conveyed to the developer restricting area 534 and the developing area 424 while passing through the nip portion of the rollers 54, 53 and resting on the developing roller 53. As a result, the developer is charged by being rubbed against each other while passing through the nip portion.

In the developer restricting area 534, the restricting member 562 mounted on the front surface of the blade 561 of the developer restricting means 56 acts on the developer resting on the outer circumferential surface of the roller 532 of the developing roller 53 to form a thin developer layer having a specified thickness thereon. The developer scraped off onto the bottom wall 511 of the housing 51 by the restricting member 562 mounted on the blade 561 of the developer restricting means 56 is conveyed along the guide surface 516*b* of the partition wall 516 without staying there since the supply roller 54 is rotated in the direction of arrow.

Further, in this embodiment, the positively chargeable toner is used as the developer and the restricting member 562 is made of silicone rubber having such charging characteristics that its charging tendency is ranked below that of the toner and is distanced from that of the developer in the electrification rank as described above. Accordingly, the restricting member 562 itself is easily negatively chargeable by the friction with the toner, which enables the toner to be more securely positively charged. Therefore, the toner can be stabilized on the negatively charged coating layer 532*b* to thereby effectively prevent an occurrence of so-called fogging or the like. As a result, a satisfactory developing operation can be performed.

Further, since the coating layer 532*b* of the developing roller 53 has similar charging characteristics as the restricting member 562, similar effects can be obtained. This is described in detail later in Examples later based on specific experimental results.

The developer held on the outer circumferential surface of the roller 532 of the developing roller 53 in the developer holding area 533 and formed into a thin layer by the action of the restricting member 562 mounted on the restricting blade 561 of the developer restricting means 56 in the developer restricting area 534 is further conveyed to the developing area 424 as the developing roller 53 is rotated in the direction of arrow.

In the developing area 424, the developer is supplied to the electrostatic latent image on the photosensitive layer provided on the outer circumferential surface of the photosensitive drum 42, thereby developing the electrostatic latent image into a toner image. For example, the electrostatic image has a non-image area positively charged at about +600V and an image area positively charged at about +120V, and the toner as the developer is adhered to the image area (i.e. reversal development). The photosensitive drum 42 and the developing roller 53 are rotated in the respective directions of arrow shown in FIG. 2. Accordingly, in the developing area 424, the outer circumferential surface of the photosensitive drum 42 and that of the roller 532 of the developing roller 53 are moved in the same direction from the lower side to the upper side. Since the peripheral velocity V2 of the roller 532 and the peripheral velocity V1 of the photosensitive drum 42 are set to satisfy the relationship: $1.2V1 \leqq V2 \leqq 2.5V1$, a sufficient amount of the developer is conveyed to the developing area 424 by the roller 532 and the developer temporarily adhered to the non-image area of the electrostatic latent image is properly scraped off by the rubbing action of the outer circumferential surface of the roller 532 on that of the photosensitive drum 42. Therefore, there can be obtained a satisfactory toner image having a suitable image density and free from fogging. On the other hand, the developer having passed the developing area 424 while resting on the outer circumferential surface of the roller 432 is transferred to the outer surface of the supply roller 54 in the nip portion between the developing roller 53 and the supply roller 54.

Since the peripheral velocity of the supply roller 54 is set larger than that of the developing roller 53, the adhering force of the developer still adhered to the developing roller 53 without being transferred to the photosensitive drum 42 when passing the developing area 424 is weakened in order to cause this developer to be transferred to the supply roller 54 in the nip portion. Accordingly, this developer can be collected, thereby preventing an occurrence of so-called ghost, which is caused by the developer still adhered to the developing roller 53 even after the image transfer.

D. Other Embodiments

Although the present invention is described above with respect to the embodiment applied to a printer, it is not limited to this illustrated embodiment. For example, the invention is also applicable to electrostatic copiers and facsimile apparatuses. A variety of modification and changes can be made without departing from the scope of the technical concept of the invention.

Further, in the foregoing embodiment, the restricting member 562 is made of silicone rubber since the positively chargeable toner is used as the developer. Besides silicone rubber, CR rubber, natural rubber, fluorocarbon rubber or like material whose charging tendency is ranked below that of the toner and is distanced from the charging tendency of the developer in the electrification rank may be used (electron attracting material). If only an increase in the charging amount is considered, it is preferred that the charging tendency be largely distanced. Further, in the foregoing embodiment, the restricting member 562 having a semicircular cross section is mounted on the restricting blade 561 and is held in the outer circumferential surface of the roller 532. Alternatively, the restricting blade 561 may be made of a material having such charging characteristics that it is positively chargeable and its charging tendency is distanced from that of the developer and have the leading end thereof directly held in contact with the outer circumferential surface of the roller 532. Although the developer is positively chargeable toner in the above description, negatively chargeable toner may also be used. In such a case, similar effects can be obtained if the restricting member 562 is made of glass, stainless steel, nylon or like material whose charging tendency is ranked above the toner and is distanced from that of the developer (electron donating material).

Furthermore, in the foregoing embodiment, (1) The coating layer 532*b* of the developing roller 53 is made to have such charging characteristics that its charging tendency is ranked below the toner if the developer is positively chargeable toner while being ranked above the toner if the developer is negatively chargeable toner, and (2) The restricting member 562 is made to have such charging characteristics that its charging tendency is ranked below the toner if the developer is positively chargeable toner while being ranked above the toner if the developer is negatively chargeable toner.

Even if only either one of (1) and (2) is adopted, the developer can be stably and securely charged at a specified polarity. However, it is more preferable to adopt both (1) and (2) since the developer can be more stably and securely charged at a specified polarity.

Although the developing operation performed by positively charging the photosensitive drum 42 and positively charging the developer by the restricting member 562, i.e. the so-called "reversal development" is described in the foregoing embodiment, the invention is also applicable to a normal development in which the charging polarity of the photosensitive drum 42 and the friction charging polarity of the developer are set opposite from each other instead of setting them at the same polarity. In other words, according to the invention, a satisfactory developing operation can be performed as described above by selecting the charging polarity of the photosensitive drum 42, the material of the coating layer 532*b* and the material of the restricting member 562 according to the charging polarity of the developer as defined in TABLE-2 below.

TABLE 2

| | Charging Polarity of PS. Drum | Charging Polarity of Developer | Material of Coating Layer | Material of Restricting Member |
|---|---|---|---|---|
| Developing Device (1) | (−) | (+) | Electron Attracting | Electron Attracting |
| Developing Device (2) | (−) | (−) | Electron Donating | Electron Donating |
| Developing Device (3) | (+) | (−) | Electron Donating | Electron Donating |
| Developing Device (4) | (+) | (+) | Electron Attracting | Electron Attracting |

E. Examples

Examples of the present invention are described below. It should be noted that the present invention is not limited to the following Examples, and is, of course, applicable by being suitably changed within the range adapted to the spirit of the description above and below, and such changes are embraced by the technical range of the present invention.

E-1. Concerning the Adherence Preventing Coating Layer 532*b*

In the foregoing embodiment, the roller 532 of the developing roller 53 is such as described that the roller main body 532*a* is made of NBR (acrylonitrile-butadiene rubber) as the roller base material and the coating layer 532*b* for preventing the adherence of the developer is formed on the outer circumferential surface of the roller main body 532*a*. On the other hand, since the developer is positively chargeable toner, the restricting member 562 of the developer restricting means 56 is made of silicone rubber whose charging tendency is ranked below the toner and distanced from that of the developer in the electrification rank. "Reflection Density", "fogging", "environmental performance", "ghost", "durability" and "cost" were studied in cases where the coating layers 1 to 6 shown in TABLE-1 were used as the material of the coating layer 532*b*. It should be noted that "environmental performance" is an estimation of image deterioration caused by a particular property of NBR to have a higher hardness at low temperatures and "durability" is an estimation of a degree of abrasion of the restricting member 562 after 3000 images are developed. For the coating layers 4, 5, "reflection density" and the like were estimated by changing the thickness thereof to 5, 10 and 20 $\mu$m. These estimation results are shown in TABLE-3.

TABLE 3

| | Reflect. Density | Fogging | Env. Performa | Ghost | Durability | Cost |
|---|---|---|---|---|---|---|
| Coating Mate. 1 | | | | | | ⊙ |
| Coating Mate. 2 | ⊙ | | ⊙ | ⊙ | ⊙ | ⊙ |
| Coating Mate. 3 | ⊙ | ( | ⊙ | ⊙ | ⊙ | ⊙ |
| Coating | ⊙⊙⊙ | ⊙⊙⊙ | x | x⊙ | ⊙⊙ | ⊙⊙x |

TABLE 3-continued

| | Reflect. Density | Fogging | Env. Performa | Ghost | Durability | Cost |
|---|---|---|---|---|---|---|
| Mate. 4 Coating | ⊙⊙ | ⊙⊙⊙ | x⊙ | x⊙ | x⊙⊙ | ⊙⊙x |
| Mate. 5 Coating | ⊙ | | ⊙ | ⊙ | ⊙ | ⊙ |
| Mate. 6 | | | | | | |

In TABLE-3, marks "×", "○" and "⊙" indicate that the coating material cannot be used, can be used, and is preferable, respectively. In the rows of the "coating materials 4, 5", three marks are written in each evaluation box. These marks are evaluation results when the thickness of the coating layer 532*b* is 5, 10 and 20 μm from the left, respectively. Other coating layers 532*b* are set at 10 μm.

As can be seen from TABLE-3, a satisfactory developing operation could be performed with the developing roller and the developing device according to the invention. Further, "Reflection Density", "fogging", "environmental performance", "ghost", "durability" and "cost" could be controlled by adjusting the thickness of the coating layer 532*b*. It is particularly preferable to set the thickness of the coating layer 532*b* in a range of 5 to 20 μm. Further experiments similar to the above showed that the adjustment of the thickness of the coating layer 532*b* was more preferable since better results could be obtained in the estimation items by doing so.

E-2. Concerning the Restricting Member 562

Figure 4A:
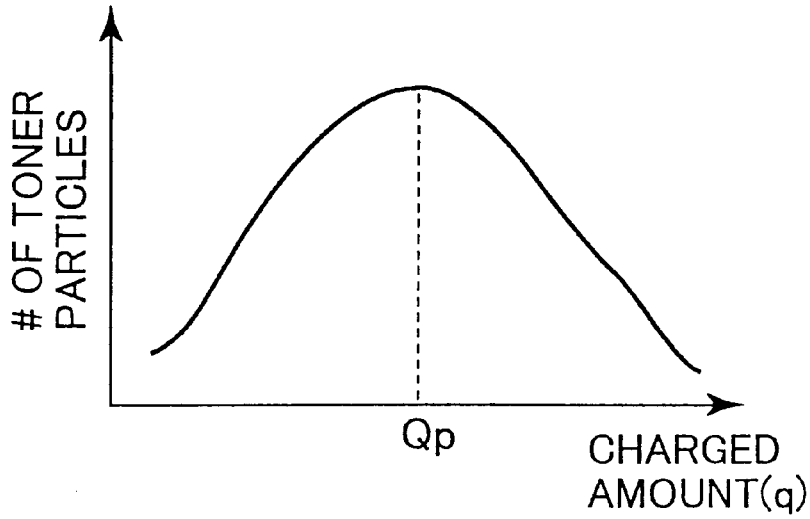
FIGS. 4A and 4B are graphs showing a distribution of charged amount in the developing device.
Figure 4B:
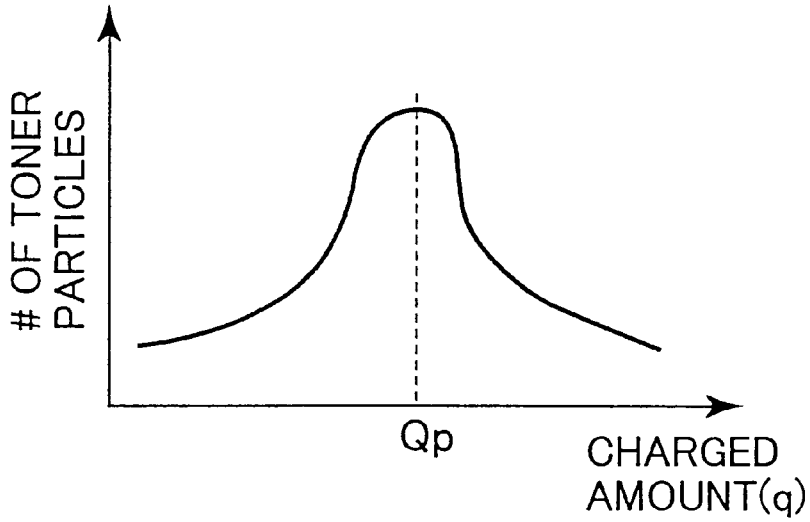

Further, a distribution of the number of toner particles in relation to a charged amount, i.e. a charged amount distribution was examined by obtaining the number of charged toner particles for each charged amount in the developing device. This examination confirmed such a tendency as shown in FIGS. 4A and 4B that the number of charged toner particles was peaked at a specified charged amount Qp at the center, and gradually decreased as the charged amount increased or decreased from the specified charged amount Qp. A study of a relationship between the thus obtained charged amount distribution and the occurrence of fogging confirmed that fogging occurred with higher frequency if the distribution curve was relatively broadly pointed as shown in FIG. 4A, and conversely it occurred with lower frequency if the distribution curve was steeply pointed as shown in FIG. 4B. In other words, in order to suppress the occurrence of fogging, it is one of the effective means to control the charged state such that the distribution curve becomes steeply pointed.

A charged amount distribution of positively chargeable toner was actually examined using the developing roller 53 constructed by forming the coating layer 532*b* for preventing the adherence of the developer on the outer circumferential surface of the roller main body 532*a* made of NBR as the roller base material, and the restricting member 562 of the developer restricting means 56 as described above. In the case that the restricting member 562 was made of silicone rubber having such charging characteristics that its charging tendency is ranked below that of the toner and is distanced from that of the developer in the electrification rank, a charged state having such a steeply pointed distribution curve as shown in FIG. 4B was obtained and no occurrence of fogging was confirmed. Similar results were obtained for CR rubber and natural rubber having similar charging characteristics as silicone rubber. In the case that the developer was negatively chargeable toner, similar results were obtained by making the restricting member 562 of glass, stainless steel, nylon or like material having such charging characteristics that its charging tendency is ranked above the that of the toner and is distanced from that of the developer.

As described above, if the restricting member 562 is made of a material having suitable charging characteristics depending on whether the developer is positively or negatively chargeable toner, a more satisfactory developing operation can be performed by suppressing an occurrence of fogging, thereby enabling the formation of an image of high quality.

E-3. Concerning the Friction Coefficient of the Coating Layer 532*a*

Next, in order to examine the influence of the friction coefficient of the coating layer 532*b* on the developing operation, the coefficient of the coating layer 532*b* was measured by a surface meter "HEIDON-14" manufactured by HEIDON®, and "negative ghost", "positive ghost" and "background fogging" were examined during the developing operations using the developing rollers 53 on which the coating layers 532*b* having various friction coefficients are formed. The estimation results are shown in TABLE-4 below. Measurement conditions for the frictional coefficient were: vertical load of "100 g" and a measurement time of 0.2 to 0.5 sec.

TABLE 4

| Fric. Coef. | 0.45 | 0.5 | 0.55 | 0.6 | 0.65 | 0.7 | 0.75 | 0.8 | 0.85 | 0.9 | 0.95 | 1 |
|---|---|---|---|---|---|---|---|---|---|---|---|---|
| Nega. Ghost | ⊙ | ⊙ | ⊙ | ⊙ | ⊙ | ⊙ | ⊙ | ○ | ○ | ○ | ○ | Δ |
| Posi. Ghost | Δ | ○ | ⊙ | ⊙ | ⊙ | ⊙ | ⊙ | ⊙ | ⊙ | ⊙ | ⊙ | ⊙ |
| Back. fog. | Δ | ○ | ○ | ⊙ | ⊙ | ⊙ | ⊙ | ⊙ | ⊙ | ⊙ | ⊙ | ⊙ |

In TABLE-4, marks "Δ", "○", "⊙" indicate a level which present a problem in practical use, a level which present no problem in practical use and a level free from problems.

As can be seen from TABLE-4, no negative ghost was confirmed when the friction coefficient is relatively low, and it started occurring at a friction coefficient of 0.8. There was no problem in practical use if the friction coefficient was below 0.95. However, if the friction coefficient exceeded 0.95, the specific charge of the toner became too high and negative ghost became a problem in practical use, with the result that no satisfactory developing operation could be performed. On the other hand, no positive ghost was confirmed when the friction coefficient was relatively high, and it started occurring at a friction coefficient of 0.5, where there was still no problem in practical. However, if the friction coefficient was below 0.45, the specific charge of the toner became too low and positive ghost became a problem in practical use, with the result that no satisfactory developing operation could be performed. Further, no background fogging was confirmed when the friction coefficient was relatively high, and it started occurring at a friction coefficient of 0.55, where there was still no problem in practical. However, if the friction coefficient was below 0.45, positive ghost became a problem in practical use, with the result that no satisfactory developing operation could be performed. Accordingly, in order to perform a satisfactory developing operation free from the problems of negative ghost, positive ghost and background fogging in practical use, the coating layer 532*b* of the developing roller 53 needs to be made such that its friction coefficient lies within a range of 0.5 to 0.95 inclusive, more preferably within a range of 0.55 and 0.8 exclusive.

E-4. Concerning the Glossiness of the Coating Layer 532*b*

Next, in order to examine the influence of the glossiness of the coating layer 532*b* on the developing operation, 450 specular glossiness of the coating layer 532*b* was measured by a measuring apapratus "VGS-1001DP(VG-200)" manufactured by Nippon Denshoku Kogyo Kabushiki Kaisha in accordance with JIS Z 8741 (specular glossiness measuring method), and "negative ghost", "positive ghost" and "background fogging" were examined during the developing operations using the developing rollers 53 on which the coating layers 532*b* having various values of glossiness are formed. The estimation results are shown in TABLE-5 below.

TABLE 5

| Glossiness | 4 | 4.5 | 5 | 6 | 7 | 7.5 | 8 | 8.5 |
|---|---|---|---|---|---|---|---|---|
| Negative Ghost | ○ | ⊙ | ⊙ | ⊙ | ⊙ | ○ | ○ | Δ |
| Positive Ghost | Δ | ○ | ⊙ | ⊙ | ⊙ | ⊙ | ⊙ | ⊙ |
| Back. Fogging | Δ | ○ | ○ | ⊙ | ⊙ | ⊙ | ⊙ | ⊙ |

In TABLE-5, marks "Δ", "○", "⊙" indicate a level which present a problem in practical use, a level which present no problem in practical use and a level free from problems.

As can be seen from TABLE-5, no negative ghost was confirmed when the glossiness was relatively low, and it started occurring at a glossiness of 7.5. There was no problem in practical use if the glossiness was below 8. However, if the glossiness exceeded 8.5, negative ghost became a problem in practical use, with the result that no satisfactory developing operation could be performed. On the other hand, no positive ghost was confirmed when the glossiness was relatively high, and it started occurring at a glossiness of 4.5, where there was still no problem in practical. However, if the glossiness was below 4, positive ghost became a problem in practical use, with the result that no satisfactory developing operation could be performed. Further, no background fogging was confirmed when the glossiness was relatively high, and it started occurring at a glossiness of 5, where there was still no problem in practical. However, if the glossiness was below 4, background fogging became a problem in practical use, with the result that no satisfactory developing operation could be performed. Accordingly, in order to perform a satisfactory developing operation free from the problems of negative ghost, positive ghost and background fogging in practical use, the coating layer 532*b* of the developing roller 53 needs to be made such that its glossiness lies within a range of 4.5 to 8 inclusive, more preferably within a range of 5 and 7.5 exclusive.

F. Effects of the Invention

As described above, according to the inventive developing roller, relatively inexpensive acrylonitrile-butadiene rubber is used as the roller base material, and the coating layer is formed on the outer circumferential surface of the roller main body made of the roller base material to prevent the adherence of the developer to the roller base. Therefore, a satisfactory developing operation can be performed. Particularly in this invention, since the friction coefficient of the coating layer lies within a range of 0.5 to 0.95 inclusive and/or the glossiness thereof lies within a range of 4.5 to 8 inclusive, neither negative ghost, positive ghost nor background fogging occurs or they can be suppressed to levels which present no problem in practical use even if they occur.

Further, according to the inventive developing device, the adherence of the developer to the roller base material can be prevented by the coating layer formed on the outer circumferential surface of the roller main body. Further, the developer restricting means held in contact with the outer circumferential surface of the developing roller has such charging characteristics that its charging tendency is ranked below the toner in the case that the developer is positively chargeable toner while being ranked above the toner in the case that the developer is negatively chargeable toner, and its charging tendency is also distanced from that of the developer in the electrification rank. Accordingly, the developer restricting means can sufficiently charge the developer to ensure a satisfactory developing operation. Further, since the coating layer of the developing roller also has similar charging characteristics as the developer restricting means, the developer can be sufficiently charged to ensure a satisfactory developing operation.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within meets and bounds of the claims, or equivalence of such meets and bounds are therefore intended to embraced by the claims.

What is claimed is:

1. A developing roller comprising:

a roller main body made of acrylonitrile-butadiene rubber as a roller base material; and a coating layer formed on the outer circumferential surface of the roller main body for preventing the adherence of developer, the coating layer including a synthetic resin layer having glossiness in a range of 4.5 to 8 inclusive.

2. A developing roller according to claim 1, wherein the coating layer has such charging characteristics that its charging tendency is ranked below the toner in case that the developer is positively chargeable toner while being ranked above the toner in case that the developer is negatively chargeable toner, and is distanced from that of the developer in the electrification rank.

3. A developing roller according to claim 1, wherein the coating layer is made of fluorocarbon resin or silicone resin having an electron attracting property.

4. A developing roller according to claim 3, wherein a main component of the coating layer is polyurethane fluoride resin.

5. A developing roller according to claim 4, wherein the thickness of the coating layer is 5 to 20 μm.

6. A developing roller according to claim 4, wherein the thickness of the coating layer is 8 to 15 μm.

7. A developing roller according to claim 1, wherein the coating layer is made of nylon resin or urethane resin having an electron donating property.

8. A developing device for visualizing an electrostatic latent image formed on a photosensitive drum by supplying developer to the photosensitive drum, comprising:

a housing for containing the developer; and a developing roller including a roller main body made of acrylonitrile-butadiene rubber as a roller base material, and a coating layer formed on the outer circumferential surface of the roller main body, the coating layer including a synthetic resin layer having a glossiness in a range of 4.5 to 8 inclusive and having a friction coefficient in a range of about 0.6 to about 0.75 inclusive for preventing the adherence of developer, the developing roller being adapted to hold the developer contained in the housing on its outer circumferential surface in a developer holding area and to convey the developer to a developing area to supply it to the photosensitive drum.

9. A developing device according to claim 8, wherein the coating layer has such charging characteristics that its charging tendency is ranked below the toner in case that the developer is positively chargeable toner while being ranked above the toner in case that the developer is negatively chargeable toner, and is distanced from that of the developer in the electrification rank.

10. A developing device according to claim 8, wherein the coating layer is made of fluorocarbon resin or silicone resin having an electron attracting property.

11. A developing device according to claim 10, wherein a main component of the coating layer is polyurethane fluoride resin.

12. A developing device according to claim 11, wherein the thickness of the coating layer is 5 to 20 $\mu$m.

13. A developing device according to claim 11, wherein the thickness of the coating layer is 8 to 15 $\mu$m.

14. A developing device according to claim 8, wherein the coating layer is made of nylon resin or urethane resin having an electron donating property.

15. A developing device for visualizing an electrostatic latent image formed on a photosensitive drum by supplying developer to the photosensitive drum, comprising:

a housing for containing the developer; and a developing roller including a roller main body made of acrylonitrilebutadiene rubber as a roller base material, and a coating layer formed on the outer circumferential surface of the roller main body having a friction coefficient in a range of about 0.6 to about 0.75 inclusive, a thickness between about 8 to about 15 $\mu$m, and glossiness in a range of about 4.5 to about 8 inclusive for preventing the adherence of developer, the developing roller being adapted to hold the developer contained in the housing on its outer circumferential surface in a developer holding area to convey the developer to a developing area to supply it to the photosensitive drum.

16. A developing device according to claim 8, a developer restricting means held in contact with the outer circumferential surface of the developing roller between the developer holding area and the developing area for restricting the thickness of a layer of the developer held on the outer circumferential surface thereof wherein the developing restricting means is made of at least one of silicone rubber, CR rubber, and natural rubber when the developer is positively charged, and the developing restricting means is made of at least one of glass, stainless steel, and nylon when the developer is negatively charged.

* * * * *